US005875569A

United States Patent [19]

Dupree

[11] Patent Number: 5,875,569

[45] Date of Patent: Mar. 2, 1999

[54] ATHLETIC SHOE WITH ANTI-INVERSION PROTECTION

[76] Inventor: Tony L. Dupree, 55 Garner Rd., Selma, N.C. 27576

[21] Appl. No.: 939,431

[22] Filed: Sep. 26, 1997

Related U.S. Application Data

[63] Continuation of Ser. No. 556,389, Nov. 13, 1995, abandoned.

[51] Int. Cl.[6] ..... A43B 13/00

[52] U.S. Cl. ..... 36/103; 36/25 R; 36/69

[58] Field of Search ..... 36/25 R, 69, 88, 36/92, 103, 127, 132, 114

[56] References Cited

U.S. PATENT DOCUMENTS

| | | | |
|---|---|---|---|
| 4,314,413 | 2/1982 | Dassler | 36/25 R |
| 4,542,598 | 9/1985 | Misevich et al. | 36/114 |
| 4,790,083 | 12/1988 | Dufour | 36/127 |
| 4,794,707 | 1/1989 | Franklin et al. | 36/20 R |
| 4,866,861 | 9/1989 | Noone | 36/69 |
| 5,265,354 | 11/1993 | Aliano, Jr. | 36/25 R |

FOREIGN PATENT DOCUMENTS

| | | | |
|---|---|---|---|
| 4134248 | 4/1992 | Germany | 36/103 |

*Primary Examiner*—M. D. Patterson
*Attorney, Agent, or Firm*—Rhodes, Coats & Bennett, LLP

[57] ABSTRACT

An athletic shoe with anti-inversion protection includes an upper attached along its lower extent to a sole portion. The sole portion includes an integrally formed wing member projecting outwardly from the lateral side of the sole portion. The wing member is spaced upwardly from the bottom of the sole portion and is located between the ankle and the ball of the user's foot. When the ankle begins to overturn, the tip of the wing member engages the ground to resist overturning.

10 Claims, 3 Drawing Sheets

ATHLETIC SHOE WITH ANTI-INVERSION PROTECTION

This application is a continuation of application Ser. No. 08/556,389, filed Nov. 13, 1995, now abandoned.

BACKGROUND OF THE INVENTION

The present invention relates generally to an improved construction for an athletic shoe. In particular, the present invention relates to an athletic shoe having means to lessen the risk of over inversion of the wearer's foot.

In strenuous sports involving rapid turning movements, such as basketball, soccer and tennis, there is an inherent risk of ankle injury due to inadequate ankle support and/or foot control. As is well known, over inversion of the foot resulting in an ankle sprain or fracture is one of the most common causes of injury. The over inversion of the foot causes a painful wrenching or tearing of the ligaments in the ankle. An injury to a ligament is not only painful and dislaboring, but can also result in permanent weakening or disability.

Hightop tennis shoes provide some protection against ankle injuries. However, athletes frequently disdain the use of hightop shoes because they are heavy, uncomfortable and restrict movement of the ankle. Even when hightop tennis shoes are used, ankle injuries still occur.

Athletes also use various forms of ankle wrapping and tape to reduce the likelihood of ankle injury. However, wrapping or taping the ankle is a time consuming process. Further, ankle wrappings and tape may cause skin irritation, are uncomfortable, and also restrict movement in the ankle.

SUMMARY OF THE INVENTION

The present invention is an athletic shoe with anti-inversion protection to prevent injury to the ankle without need for wrapping the ankle. The athletic shoe of the present invention comprises an upper attached about its lower extent to a sole portion. A wing member projects outwardly from the lateral side of the sole portion and includes a tip adapted to engage the ground. The wing member is spaced upwardly from the sole portion of the shoe and is located forwardly of the ankle. When the ankle begins to overturn, the tip of the wing portion is brought into engagement with the ground to resist further overturning. The additional resistance to overturning provided by the wing member lessens the risk of serious injury.

Accordingly, it is a primary object of the present invention to provide an anti-inversion device for an athletic shoe to help protect the wearer against ankle injury.

Another object of the present invention is to provide an anti-inversion device for an athletic shoe to prevent inversion of the wearer's ankle.

Another object of the present invention is to provide an anti-inversion device for an athletic shoe which will not impinge on the movement of the wearer's ankle.

Another object of the present invention is to provide an anti-inversion device for an athletic shoe that can be conveniently and economically incorporated into an athletic shoe without increasing the cost thereof.

Other objects and advantages of the present invention will become apparent and obvious from a study of the following description and the accompanying drawings which are merely illustrative of such invention.

DETAILED DESCRIPTION OF THE INVENTION

Figure 1:
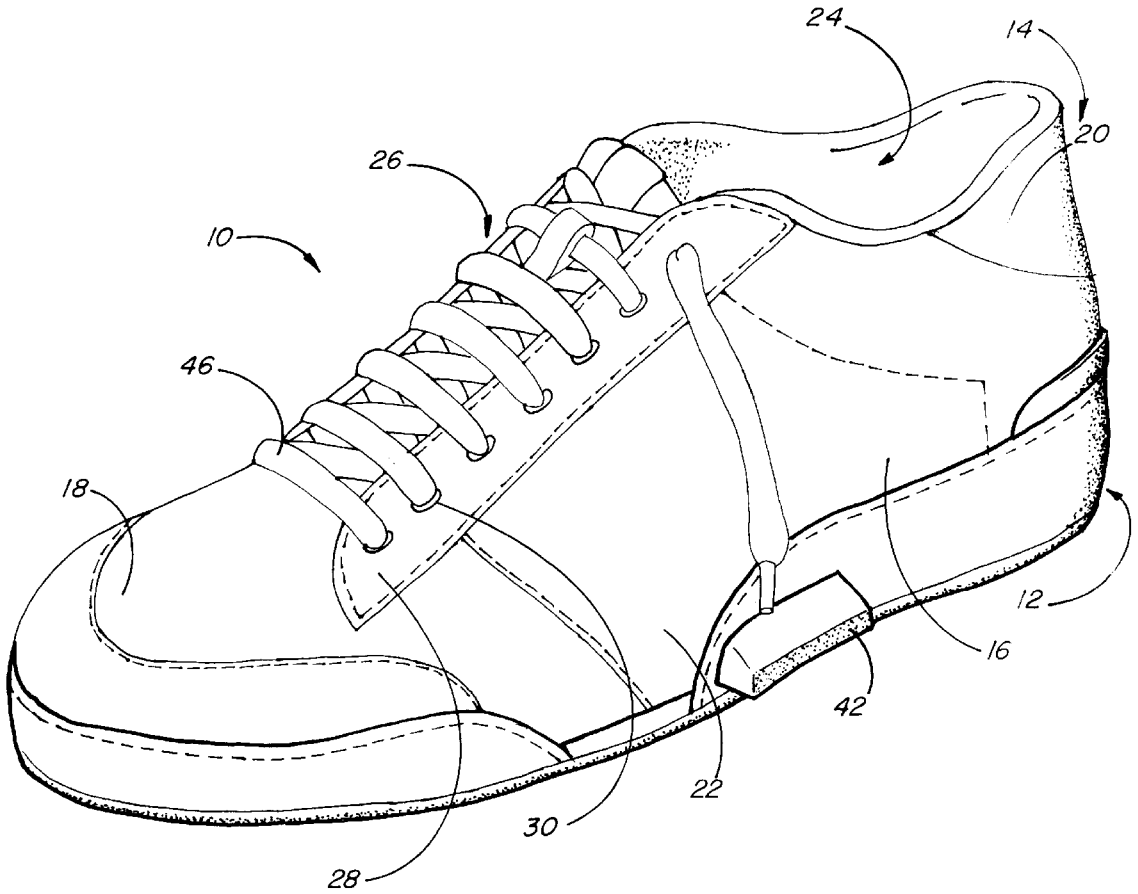
FIG. 1 is a perspective view of the athletic shoe of the present invention showing the anti-inversion device.

FIG. 1 shows a perspective view of the athletic shoe incorporating an anti-inversion device in accordance with the present invention. The athletic shoe is indicated generally by the numeral 10. The athletic shoe includes a sole portion 12, and an upper 14 attached about its lower extent to the sole portion 12.

The upper 14 is conventional in construction and includes a main body section 16 and a toe section 18, which are preferably made of a strong, wear-resistant material such as leather or vinyl. Other materials, such as nylon mesh, which provide high strength and breatheability, can also be used. The main body section 16 comprises a heel portion 20 and side portions 22 which extend along the lateral and medial sides of the foot. The heel portion 20 may include an internal stiffener (not shown) to prevent the collapsing of the heel.

The upper 14 defines an ankle opening 24 through which the foot is inserted and a tongue opening 26. Lace hole reinforcing members 28 extend along both sides of the tongue opening 26 from the ankle opening 24 to the toe section 18. Lace hole reinforcing members 28 include a plurality of lace holes 30. A shoe lace 46 is threaded through the lace holes 26 in a conventional manner and serves to secure the shoe 10 on the foot of the wearer. It is appreciated, however, that other fastening means, such as VELCRO type fasteners, may be utilized in connection with the present invention.

Figure 2:
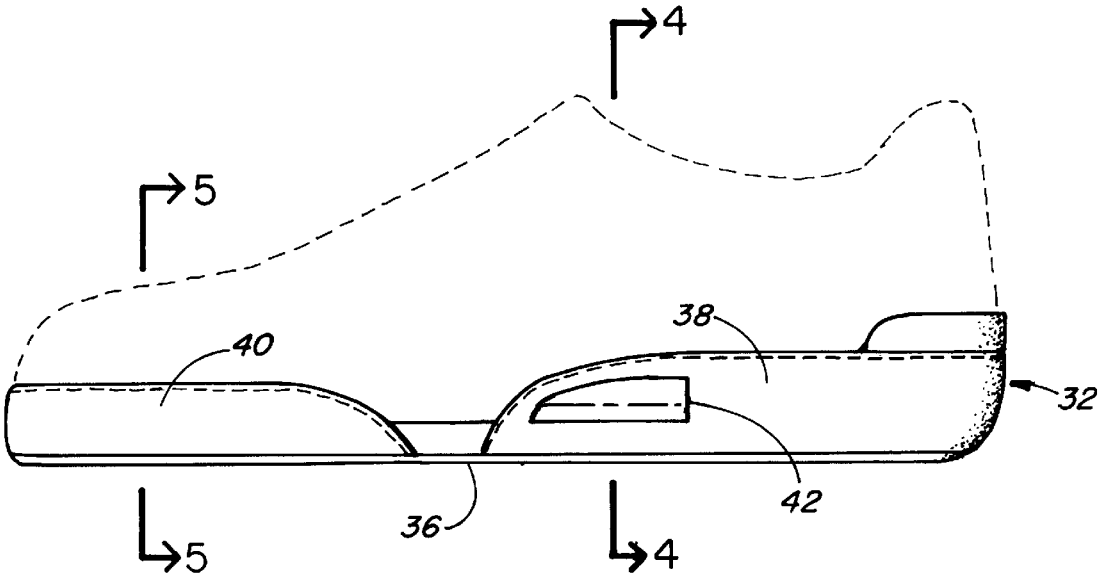
FIG. 2 is an elevation view of the athletic shoe shown from the outside.
Figure 3:
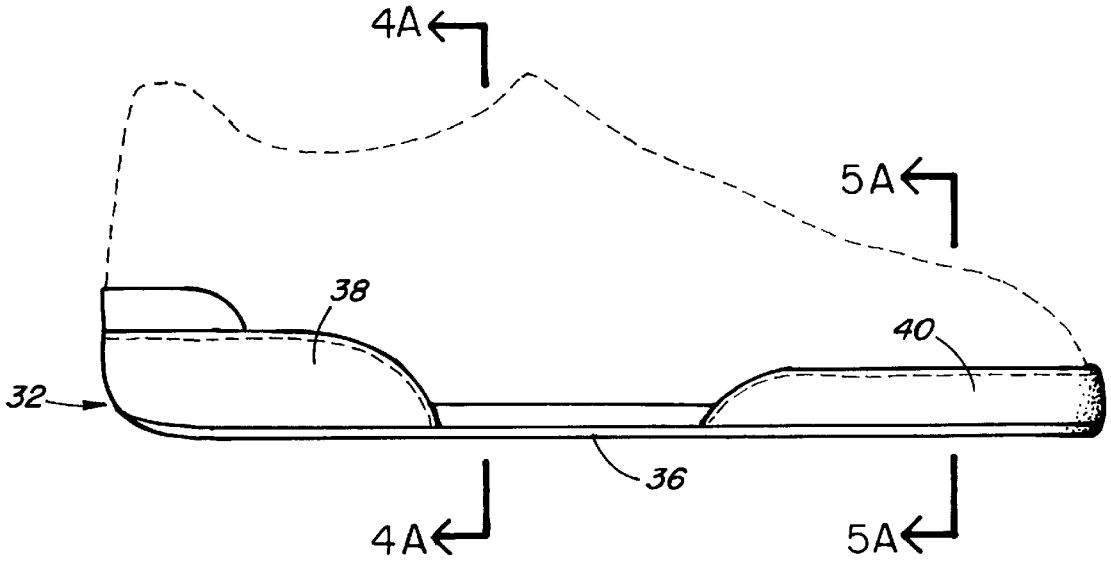
FIG. 3 is an elevation view of the athletic shoe shown from the inside.
Figure 4:
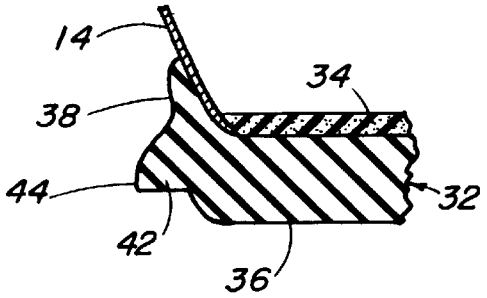
FIG. 4 is a fragmented section view taken through line 4—4 of FIG. 2.
Figure 4A:
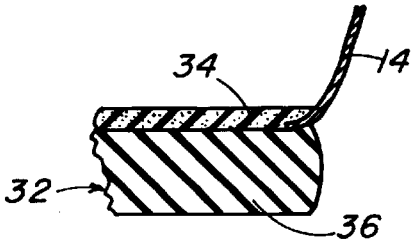
FIG. 4A is a fragmented section view taken through line 4A—4A of FIG. 3.
Figure 5:
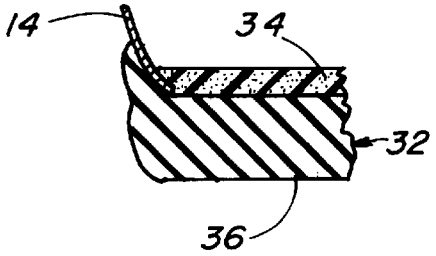
FIG. 5 is a fragmented section view taken through line 5—5 of FIG. 2.
Figure 5A:
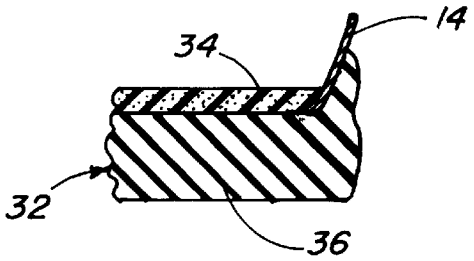
FIG. 5A is a fragmented section view taken through line 5A—5A of FIG. 3.

Referring now to the sole portion 12, it includes an outsole 32 and a midsole 34. The outsole 32, shown in FIGS. 2 and 3 includes a bottom portion or tread portion 36. A first side wall portion 38 is integrally formed with the bottom portion 36 and extends around the heel portion of the shoe to provide lateral support for improved rear foot control. The first side wall portion 38 extends forward of the ankle opening into the mid-section of the shoe on the lateral side of the shoe where the greatest support is needed. (See FIGS. 2 and 4) On the medial side of the shoe, the first side wall 38 extends slightly beyond the wearer's ankle. A second side wall 40 is integrally formed with the bottom portion 36 and extends around the toe section 18 of the shoe to provide lateral support to the wearer's foot. The second side wall 40 extends from the front of the shoe to a point slightly beyond the metatarsal joints of the wearer's foot. (See FIGS. 5 and 5A) By providing additional lateral support and improved control for the foot, the first and second side walls 38 and 40 will reduce fatigue and help prevent foot and ankle injuries.

As an additional measure of protection, the present invention includes an anti-rollover device to resist over-inversion of the ankle. The anti-rollover device comprises a wing member 42 having a generally triangular configuration and a blunt, ground engaging tip 44. The wing member 42 is integrally formed with the outsole 32 on the lateral side of the shoe since most ankle injuries occur when the ankle is turned outwardly. For additional protection, a second wing member may be added to the medial side of the shoe to prevent inward turning of the ankle, although such is not required.

The dimensions of the wing member should be positioned to resist ankle rollover. These dimensions will necessarily vary depending on the size of the shoe. For a men's size 9 shoe, the wing member 42 is spaced approximately ¼ inch above the bottom of the sole portion 12 and projects outwardly from the lateral side of the sole portion approximately ¾ of an inch. The length of the wing member is approximately 3½ inches long, and the rear of the wing member is disposed slightly forward of the wearer's ankle.

Figure 6:
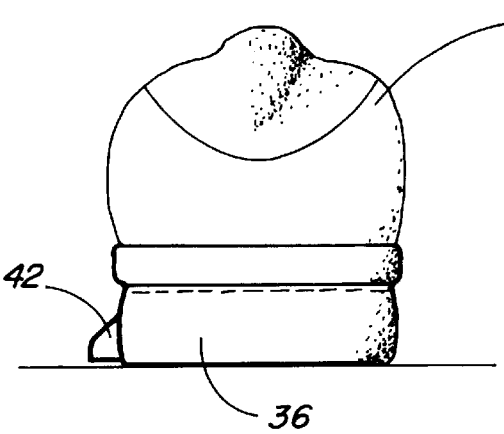
FIG. 6 is an elevation view of the athletic shoe shown from the rear with the wearer's foot being flat on the ground.
Figure 7:
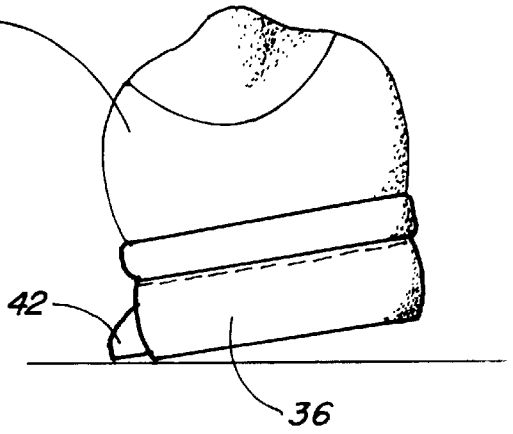
FIG. 7 is an elevation view of the athletic shoe shown from the rear with the wearer's ankle being slightly over-inverted and the tip of the wing member engaging the ground.

In use, the shoe is worn on the user's foot in the same manner as a conventional shoe. The shoe 10 is inserted onto the foot of the user and is secured by pulling the laces 46 together and then tying them. In normal use, when the foot makes generally flat contact with the ground as shown in FIG. 6, the wing member 42 will not impede movement. However, when the ankle begins overturning as shown in FIG. 7, the tip 44 of the wing member will engage the ground to resist further overturning which might result in severe ankle injury.

Based on the foregoing, it is apparent to those skilled in the art that the present invention provides protection against ankle rollover and lessens the risk of severe ankle injury. The anti-rollover device can be incorporated into existing shoes with only slight modifications to the molds and without increasing the cost of the shoe. Further, the anti-rollover device of the present invention will not in any way impede movement or flexibility.

What is claimed is:

1. An athletic shoe with anti-rollover protection comprising:

a) an outsole portion having a bottom portion and a side portion;

b) an upper attached to the outsole portion;

c) a wing member integrally formed with the outsole portion: and projecting outwardly from said side portion on the lateral side of the shoe; said wing member including a generally flat underside and a topside which slopes downwardly and outwardly from said outsole portion, said underside being spaced above and generally parallel to said bottom portion; and wherein said wing member is adapted to engage the ground surface upon overturning of the wearer' ankle to resist further overturning.

2. The athletic shoe according to claim 1 wherein the wing member is spaced approximately ¼ inch above the bottom of the outsole portion.

3. The athletic shoe according to claim 1 wherein the wing member extends approximately ¾ inch from the lateral side of the outsole portion.

4. The athletic shoe according to claim 1 wherein the length of the wing member is approximately 2–4 inches.

5. The shoe according to claim 1 further including a side wall extending around a heel portion of the shoe to provide lateral support for the heel of the wearer's foot.

6. The shoe according to claim 1 further including a side wall portion extending around a toe section of the shoe for providing lateral support for the wearer's forefoot.

7. An athletic shoe with anti-rollover protection comprising:

a) an outsole portion including a bottom portion and a first side wall extending around a heel portion of the shoe, and a second side wall portion extending around the toe section of the shoe, wherein the first and second side wall portions provide lateral support for the wearer's foot;

b) an upper attached to the outsole portion;

c) a wing member integrally formed with the outsole portion and projecting outwardly from a side wall portion on the lateral side of the shoe; said wing member including a generally flat underside and a topside which slopes downwardly and outwardly from said outsole portion, said underside being spaced above and generally parallel to said bottom portion; and wherein said wing member is adapted to engage the ground surface upon overturning of the wearer' ankle to resist further overturning.

8. The athletic shoe according to claim 7 wherein the wing member is spaced approximately ¼ above the bottom of the outsole portion.

9. The athletic shoe according to claim 7 wherein the wing member extends approximately ¾ of an inch from the lateral side of the outsole portion.

10. The athletic shoe according to claim 7 wherein the length of the wing member is approximately 2–4 inches.

* * * * *